US010018207B2

(12) United States Patent
Vigholm et al.

(10) Patent No.: US 10,018,207 B2
(45) Date of Patent: Jul. 10, 2018

(54) ARRANGEMENT FOR CHARGING AN ACCUMULATOR

(75) Inventors: Bo Vigholm, Stora Sundby (SE); Andreas Ekvall, Hallstahammar (SE); Kim Heybroek, Kvicksund (SE)

(73) Assignee: Volvo Construction Equipment AB, Eskilstuna (SE)

( * ) Notice: Subject to any disclaimer, the term of this patent is extended or adjusted under 35 U.S.C. 154(b) by 1285 days.

(21) Appl. No.: 14/110,162

(22) PCT Filed: Apr. 8, 2011

(86) PCT No.: PCT/SE2011/000065

§ 371 (c)(1),
(2), (4) Date: Oct. 28, 2013

(87) PCT Pub. No.: WO2012/138264

PCT Pub. Date: Oct. 11, 2012

(65) Prior Publication Data

US 2014/0144130 A1 May 29, 2014

(51) Int. Cl.

| | |
|---|---|
| ***E02F 9/22*** | (2006.01) |
| ***F15B 1/04*** | (2006.01) |
| ***F15B 1/02*** | (2006.01) |

(52) U.S. Cl.

CPC ..... *F15B 1/04* (2013.01); *E02F 9/226* (2013.01); *E02F 9/2207* (2013.01); *E02F 9/2217* (2013.01); *E02F 9/2292* (2013.01); *E02F 9/2296* (2013.01); *F15B 1/021* (2013.01); *F15B 2211/20546* (2013.01);

(Continued)

(58) Field of Classification Search

CPC ..... E02F 9/2292; E02F 9/226; E02F 9/2207; E02F 9/2296; E02F 9/2217; F15B 1/021; F15B 1/04

See application file for complete search history.

(56) References Cited

U.S. PATENT DOCUMENTS

| | | | |
|---|---|---|---|
| 4,995,517 | A | 2/1991 | Saotome |
| 5,034,892 | A | 7/1991 | Saotome |

(Continued)

FOREIGN PATENT DOCUMENTS

| | | | |
|---|---|---|---|
| EP | 1571267 | A2 | 9/2005 |
| WO | 9813603 | A1 | 4/1998 |
| WO | 9916981 | A1 | 4/1999 |

OTHER PUBLICATIONS

International Search Report (dated Dec. 19, 2011) for corresponding International application No. PCT/SE2011/000065.

(Continued)

*Primary Examiner* — Nathaniel Wiehe
*Assistant Examiner* — Abiy Teka
(74) *Attorney, Agent, or Firm* — WRB-IP LLP

(57) ABSTRACT

An arrangement for charging an accumulator with hydraulic fluid is provided. The accumulator is used in a hydraulic boom suspension system for a lift arm of a vehicle and the arrangement includes a first hydraulic pump arranged to supply hydraulic fluid to a hydraulic cylinder system of the lift arm, and a second hydraulic pump arranged to supply hydraulic fluid to a second hydraulic system. The second hydraulic pump is further arranged to supply hydraulic fluid for charging the accumulator.

19 Claims, 4 Drawing Sheets

(52) U.S. Cl.
CPC ..... *F15B 2211/20576* (2013.01); *F15B 2211/625* (2013.01); *F15B 2211/8613* (2013.01)

(56) References Cited

U.S. PATENT DOCUMENTS

| | | | | |
|---|---|---|---|---|
| 5,706,657 | A * | 1/1998 | Amborski | F16F 15/0275 60/413 |
| 5,733,095 | A | 3/1998 | Ahearn et al. | |
| 6,321,534 | B1 | 11/2001 | Ahearn et al. | |
| 6,848,255 | B2 * | 2/2005 | Chiaramonte | F01P 7/044 60/456 |
| 7,905,088 | B2 * | 3/2011 | Stephenson | E02F 9/2217 60/414 |
| 2003/0015847 | A1 | 1/2003 | Chatterjea | |
| 2004/0000141 | A1 * | 1/2004 | Nagura | F16D 31/00 60/413 |
| 2009/0094973 | A1 * | 4/2009 | Cheong | E02F 9/2228 60/422 |
| 2009/0100830 | A1 * | 4/2009 | Schneider | F15B 1/024 60/413 |

OTHER PUBLICATIONS

European Search Report (dated Nov. 7, 2014) for corresponding European App. EP 11 86 2893.

* cited by examiner

ARRANGEMENT FOR CHARGING AN ACCUMULATOR

BACKGROUND AND SUMMARY

The present invention relates to an arrangement for charging an accumulator. The arrangement is suitable for use in for example working machines.

Working machines, such as wheel loaders and excavators and other construction equipment are often equipped with a hydraulic oil pressure system that powers e.g. the boom operating system and the arm and bucket lifting system. The hydraulic system may be equipped with a suspension system in order to take up load variations and to relieve the system from sharp impulses. On wheel loaders, such a system is used to damp the boom and is referred to as a boom suspension system (BSS). The BSS system utilities a gas/oil accumulator connected to the lift cylinders to absorb shocks and smooth out rough roads. This in turn allows for faster cycle times and less spillage and will also increase the comfort of the operator. When the boom suspension system is activated, the accumulator is connected to the lift cylinder system.

The boom suspension system can however not be used constantly. During some of the operations performed by the vehicle, the BSS system must be deactivated in order to obtain a high precision and a high stiffness of the system, e.g. when loading gravel or handling pallets. The boom suspension system can thus be deactivated temporarily by the vehicle control system when certain operations are chosen by the operator. One common operation when the boom suspension system is deactivated is when the kick down of the vehicle is engaged. The kick down function is selected by engaging a switch which at the same time engages the first gear of the vehicle. The kick down is used when loading heavy material such as gravel, stones or the like, in order to obtain a high breakout torque.

When the boom suspension system is deactivated, the pressure in the accumulator and the lift cylinders will no longer correspond to each other. When the boom suspension system is deactivated, the different pressures are of no concern. However, it is important that the pressure is the same in both the accumulator and the lift cylinders when the boom suspension system is activated again. If the two systems have different pressures, the boom will move some in an uncontrolled way. If the pressure is higher in the accumulator, the boom would move upwards some and if the pressure in the accumulator is lower, the boom would drop.

Most often in actual operations, the pressure in the lift cylinders is relatively low or close to zero when the boom suspension system is deactivated by the vehicle control system. This is because the first gear, i.e. the kick down, is mostly used when loading and on those occasions, the bucket is lowered, which means that the pressure in the lift cylinders is low. After the loading, the bucket is full and is raised some, which means that the pressure in the lift cylinders is high. It would be detrimental to connect the high pressure lift cylinders to an empty accumulator or to an accumulator having a much lower pressure.

For this reason, the accumulator is commonly charged to a high pressure when the boom suspension system is deactivated. The accumulator is then drained during activation of the boom suspension system such that the pressure in the accumulator corresponds to the pressure in the lift cylinders prior to the connection of the accumulator to the lift cylinders. In a common system, the accumulator is charged to approximately 150 bars. Since the pressure in the lift cylinders is normally lower than 150 bars when the BSS is activated, it is ensured that the pressure in the accumulator will be sufficient for a smooth activation of the BSS. The charging of the accumulator is done by using the hydraulic main pump that powers the lift cylinders. A pressure regulator valve is used to limit the charging pressure of the accumulator to the predefined pressure, e.g. to 150 bars. A pressure balancing circuit is used to balance the pressure in the accumulator to the pressure of the lift cylinder when the BSS is activated.

One drawback with the current charging system is that energy is lost each time oil is drained from the accumulator to balance the pressure. This in turn increases the fuel consumption of the vehicle. The accumulator is often filled at maximum pump pressure which causes further pressure losses. There is thus a need for an improved accumulator charging arrangement.

It is desirable to provide an improved arrangement for charging an accumulator of a vehicle. It is also desirable to provide an improved method for charging an accumulator of a vehicle.

In an arrangement for charging an accumulator with hydraulic fluid, wherein the accumulator is used in a hydraulic boom suspension system for a lift arm of a vehicle, the arrangement comprising a first hydraulic pump arranged to supply hydraulic fluid to a hydraulic cylinder system of the lift arm, and a second hydraulic pump arranged to supply hydraulic fluid to a second hydraulic system, the second hydraulic pump is further arranged to supply hydraulic fluid for charging the accumulator.

By the accumulator charging arrangement according to the invention, an arrangement in which an accumulator is charged by a second hydraulic oil pump, which is arranged for driving a second hydraulic system, is used to charge the accumulator is obtained. In this way, the first hydraulic oil pump, which may be a main pump, is relieved from the accumulator charging which means that the full capacity of the first pump can be used for the handling of an implement, such as a bucket during loading. At the same time, it is easier to set and control the second hydraulic pump individually to the requirements for charging the accumulator.

In an advantageous development of the inventive accumulator charging arrangement, the second hydraulic pump is arranged to supply hydraulic fluid to a hydraulic motor for driving a cooling fan of the vehicle. Since the hydraulic pump for the cooling fan is designed to handle the cooling of the vehicle at extreme temperatures and loads, the cooling fan pump will have capacity to spare in most of the cases. By temporarily disengaging the cooling fan from the second hydraulic pump, the second hydraulic pump can be controlled specifically for the charging of the accumulator.

In an advantageous development of the inventive accumulator charging arrangement, the second hydraulic pump is arranged to be controlled by a pressure regulator valve, by which the pressure of the second hydraulic pump can be set by an electric signal from an ECU. In this way, the ECU can control the charging process in an energy efficient manner. By setting a required pressure level for the second hydraulic pump, excessive charging of the accumulator can be avoided. A further advantage is that the pressure loss is lower when the accumulator is charged with a lower pressure difference.

In an advantageous development of the inventive arrangement, the arrangement comprises a first charging function adapted to charge the accumulator to a first pressure when the boom suspension system is inactivated and a second charging function adapted to charge the accumulator to a second pressure when a control signal indicates that the boom suspension system is to be activated. The advantage of dividing the charging process of the accumulator is that a first charging step can be performed when the boom suspension system is in an inactive state. By pre-charging the accumulator to a first pressure, the accumulator will be partly charged when the boom suspension system is to be activated. The charging to the required pressure will thus take shorter time. When the boom suspension system is to be activated, a control signal is sent to the ECU. The ECU will complete the charging of the accumulator before the accumulator is connected to the lift cylinder system. One advantage of this is that the delay when activating the boom suspension system will be reduced. Another advantage is that the accumulator will not be overcharged which will preserve energy. A further advantage is that the accumulator is charged with a more moderate pressure difference. In conventional boom suspension systems, the accumulator is overcharged by the main hydraulic pump and the excessive pressure is drained before the accumulator is connected to the lift arm hydraulic cylinder system.

The first pressure is preferably set to a value that is most often below the pressure in the lift cylinder system when the boom suspension system is to be activated, i.e. the pressure in the lift cylinder system when the bucket is loaded. By setting the first pressure to a value below the required value, there is no need to drain hydraulic oil from the accumulator. For a typical wheel loader, the first pressure is preferably in the range between 80 and 120 bar. The second pressure is preferably substantially equal to the current load pressure in the lift arm hydraulic cylinder system when the boom suspension system is to be activated. In this way, there will be no need to drain the accumulator of excessive hydraulic oil. By connecting the accumulator to the lift arm hydraulic cylinder system when the pressure in the accumulator is substantially equal to the current load pressure in the lift arm hydraulic cylinder system, the activation of the boom suspension system will be smooth without sudden unexpected moves of the lift arms.

In an advantageous development of the inventive arrangement, the first and/or the second charging function comprises a predefined pressure ramp function. In this way, the charging of the accumulator can be performed in an energy efficient way with reduced losses. By adapting the pressure ramp function to the rotational speed of the second hydraulic pump, the losses can be reduced further. It is also possible to adapt the pressure ramp function to other parameters, such as the hydraulic oil temperature, in order to optimize the charging process further.

In an advantageous development of the inventive arrangement, the arrangement further comprises a valve means that is adapted to connect the first hydraulic pump to the accumulator and to disconnect the second pump from the accumulator when a temperature signal for the cooling fan is above a predefined level and/or when a brake pressure signal is below a predefined level. In this way, the accumulator can be charged even in extreme situations, e.g. when the cooling system is at its maximum capacity. Instead of delaying the charging of the accumulator, the first pump is used to charge the accumulator in a conventional manner, with an overcharging of the accumulator and with a subsequent draining of the pressure to the appropriate pressure level.

In an advantageous development of the inventive arrangement, the valve means is spring-loaded such that the first hydraulic pump is connected to the accumulator and that the second pump is disconnected from the accumulator when the valve means receives no electrical signal. In this way, the accumulator can be charged even when the cabling to the valve means is broken or when the ECU output to the valve means is broken.

In an advantageous method for charging an accumulator with hydraulic fluid, where the accumulator is used in a hydraulic boom suspension system for a lift arm of a vehicle, and where the lift arm is provided with a hydraulic cylinder system, the steps of charging the accumulator to a first pressure when the boom suspension system is inactivated, and charging the accumulator to a second pressure when a control signal indicates that the boom suspension system is to be activated are comprised. By dividing the charging of the accumulator into two steps, an energy preserving accumulator charging method is obtained, which at the same time minimizes the delay when activating the boom suspension system. The control signal may e.g. be generated when a reverse gear of the vehicle is activated.

In an advantageous development of the inventive method, the second pressure is substantially equal to the current load pressure in the lift arm hydraulic cylinder system. By limiting the second pressure to the actual pressure in the lift arm hydraulic cylinder system, excessive charging is avoided. By connecting the accumulator to the lift arm hydraulic cylinder system when the second pressure is substantially equal to the current load pressure in the lift arm hydraulic cylinder system, a smooth activation of the boom suspension system is obtained, with no unexpected moves of the lift arms.

In an advantageous development of the inventive method, the accumulator is charged according to a ramp function. In this way, the charging of the accumulator can be adapted to the hydraulic system of the vehicle.

In an advantageous development of the inventive method, a first hydraulic pump is arranged to supply hydraulic fluid to the lift arm hydraulic cylinder system, and a second hydraulic pump is arranged to supply hydraulic fluid to a hydraulic motor for driving a cooling fan of the vehicle, and to charge the accumulator to the first pressure and the second pressure. By using the hydraulic pump that is used to power the cooling fan, the first pump can be used solely for the hydraulic lift system.

In an advantageous development of the inventive method, the second hydraulic pump is controlled by a pressure regulator valve, whereby the pressure of the second hydraulic pump is set by an electric signal. In this way, the charging of the accumulator can be optimized by reducing the losses in the pump.

In an advantageous development of the inventive method, the flow of the second hydraulic pump is controlled by controlling the displacement of the second hydraulic pump, whereby the flow of the second hydraulic pump is set by an electric displacement signal. In this way, the charging of the accumulator can be optimized by reducing the losses in the pump.

By charging the accumulator according to a ramp function, the losses can be reduced further. The ramp function can be adapted to operating parameters of the second hydraulic pump, such as the rotational speed of the second hydraulic pump. The temperature of the hydraulic oil and/or the outer temperature can also be used as an input parameter.

In an advantageous development of the inventive method, the first hydraulic pump is connected to the accumulator and the second pump is disconnected from the accumulator when a temperature signal for the cooling fan is above a predefined level and/or when a brake pressure signal is below a predefined level. In this way, the accumulator can be charged also when the second hydraulic pump is fully occupied. The accumulator can thus be charged without having to wait for the second hydraulic pump to be available. This reduces the delay time for the activation of the boom suspension system.

BRIEF DESCRIPTION OF DRAWINGS

The invention will be described in greater detail in the following, with reference to the attached drawings, in which.

DETAILED DESCRIPTION

The embodiments of the invention with further developments described in the following are to be regarded only as examples and are in no way to limit the scope of the protection provided by the claims.

Figure 1:
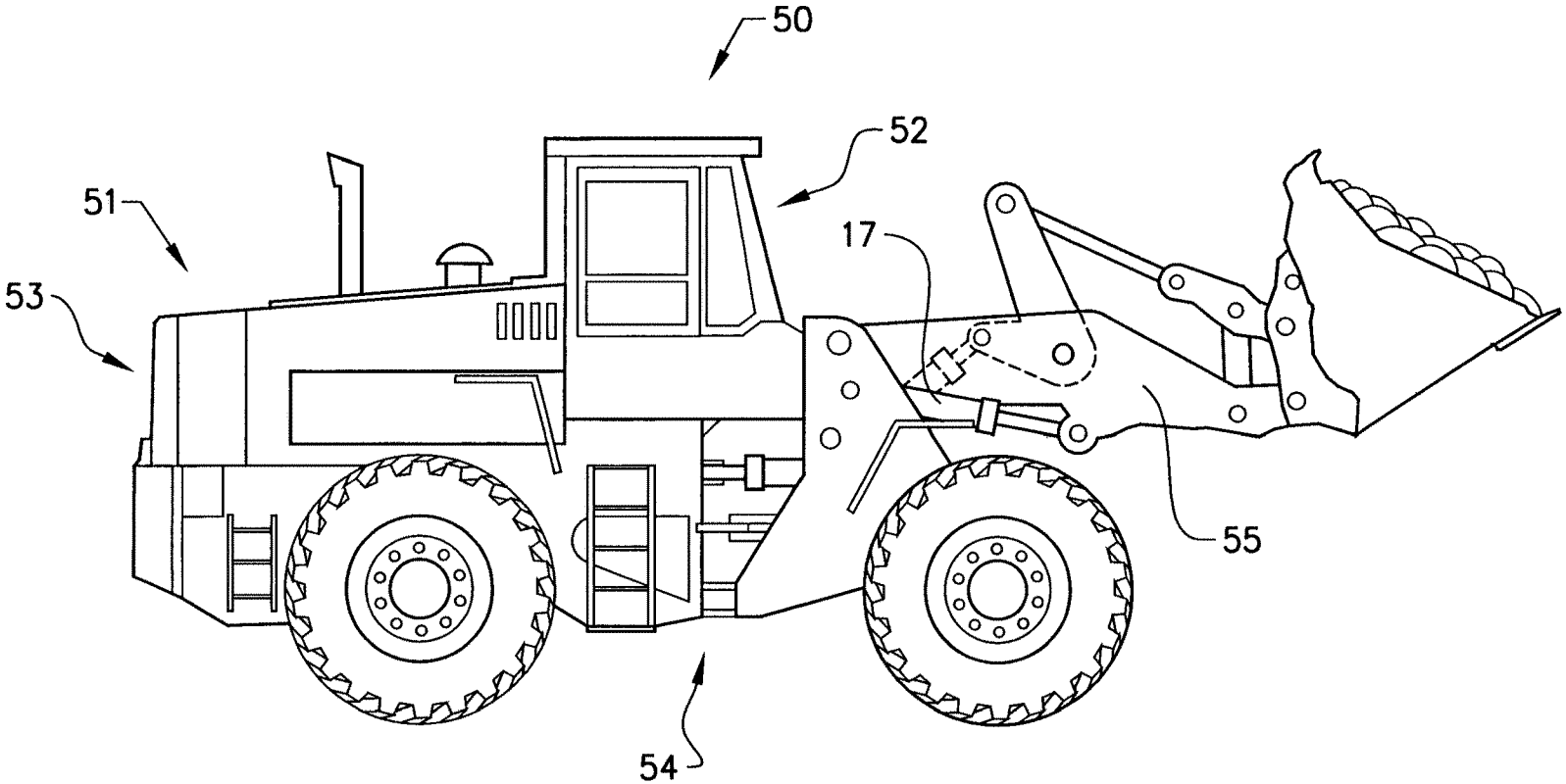
FIG. 1 shows a side view of a wheel loader having a bucket for loading operations, and comprising a lift arm hydraulic cylinder system for operating the bucket.

FIG. 1 is an illustration of a working machine 50 in the form of a wheel loader. The wheel loader comprises a bucket arranged on lift arms 55 for lifting and lowering the bucket and the bucket can further be tilted relative to the lift arms. The wheel loader 50 is provided with a hydraulic system 54 comprising at least one hydraulic machine (not shown in FIG. 1). The hydraulic machine or pump can be used for providing the hydraulic cylinders with hydraulic fluid, for example to lift and tilt the bucket. The hydraulic system also comprises an inventive arrangement for charging the accumulator used with the boom suspension system.

In the example embodiment illustrated in FIG. 1 the hydraulic system comprises two hydraulic lift cylinders 17 for the operation of the lift arms 55 and a hydraulic cylinder for tilting the bucket. The hydraulic lift cylinders are powered by a main hydraulic pump comprised in the hydraulic system of the vehicle. Furthermore the hydraulic system comprises a second hydraulic pump arranged to power a second hydraulic system. In the shown example, the second hydraulic pump is arranged to supply hydraulic fluid to a hydraulic motor for driving a cooling fan of the vehicle. The second hydraulic pump may also be arranged to supply oil to other hydraulic systems arranged on a vehicle, such as the hydraulic brake system, a hydraulic steering system and the like. The wheel loader further comprises an engine compartment 51 having an engine with a radiator system 53 and a driver cab 52.

Figure 2:
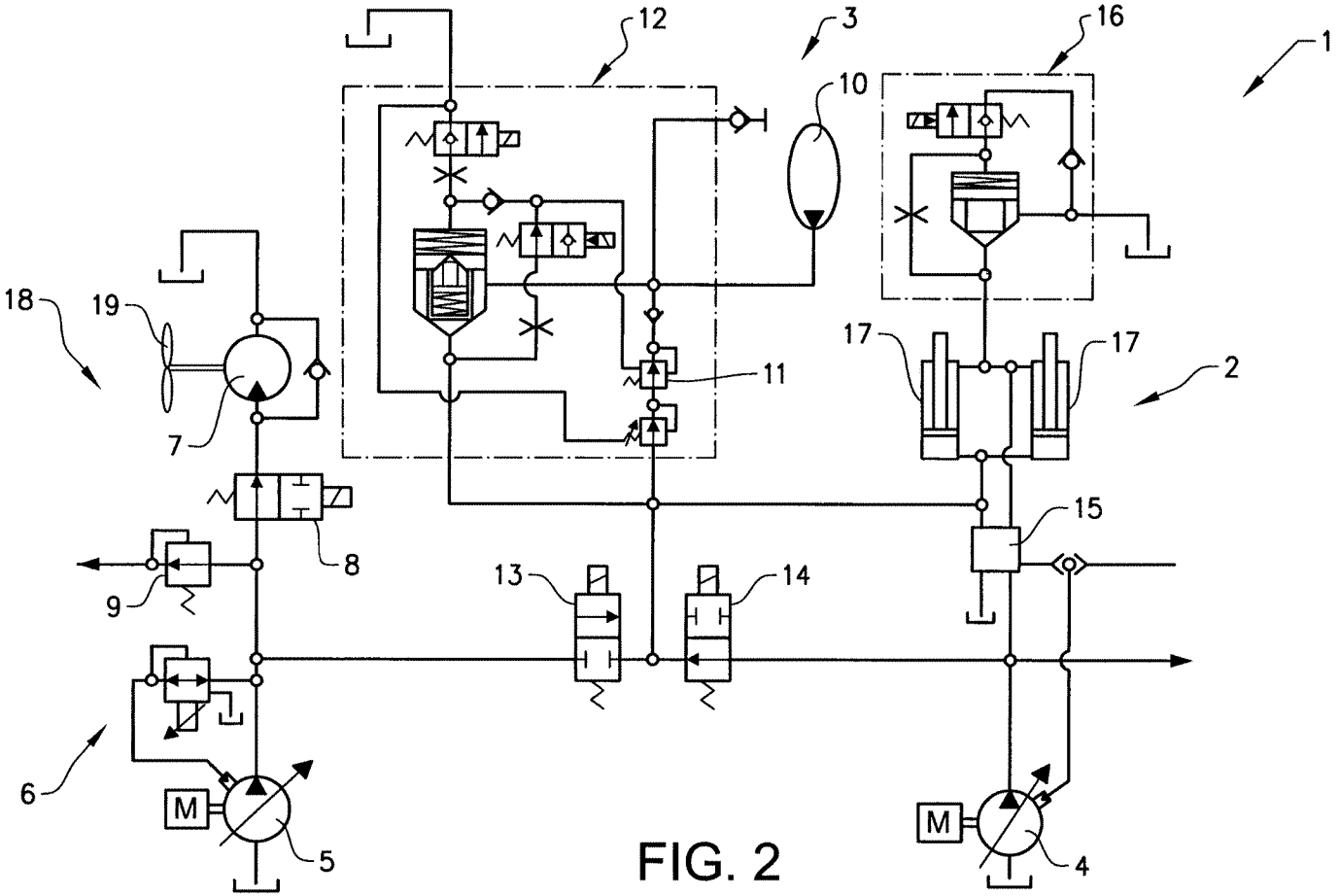
FIG. 2 shows a schematic hydraulic system comprising an accumulator charging arrangement according to the invention.

FIG. 2 shows schematically part of the hydraulic system used in the heavy vehicle. In the shown example, a wheel loader is used as an example of a heavy vehicle, but also other types of heavy vehicles are plausible. The part of the hydraulic system shown comprises the lift arm hydraulic cylinder system 2 with the boom suspension system 3, an inventive accumulator charging system 1 and the radiator cooling system 18.

The lift arm hydraulic cylinder system 2 comprises at least one lift cylinder 17, in the shown example two lift cylinders are used, a lift valve 15 which is operated by an operator for lifting and lowering the bucket. The lift arm hydraulic cylinder system 2 is powered by a first hydraulic pump 4. A valve 16 is also connected to the hydraulic cylinder system 2. Valve 16 allows excessive hydraulic fluid to be drained when the boom suspension system is activated. The first hydraulic pump 4 may also be shared by other systems of the vehicle, which are controlled by the load sensing system of the vehicle. The fluid from the first hydraulic pump 4 is fed to the lift cylinders via the lift valve 15 which is controlled by the operator, either directly or through the vehicle control system. The speed of the lift cylinders will thus vary depending on the operation performed by the operator. The first hydraulic pump 4 can also be connected to the accumulator through a BSS valve 12, which limits the charging pressure to a predefined level, e.g. 150 bars. In conventional systems, the first pump 4 is connected directly to the BSS valve 12 and the accumulator 10. In the inventive system, the connection of the main pump to the accumulator and the BSS valve 12 is governed by an electrically controlled valve 14, which is controlled by the vehicle control system. During normal operation of the vehicle, valve 14 will be closed. Valve 14 is spring-loaded such that the idle position of the valve is open.

The radiator cooling system 18 comprises a cooling fan motor 7 which is powered by a hydraulic fluid, such as hydraulic oil. The hydraulic oil is supplied from a cooling fan pump 5 which is controlled by the pressure regulator valve 6. The pressure regulating valve 6 is controlled by an electrical signal which can set the required output pressure from the pump. In this way, the pump can be regulated to specific requirements. One such requirement is the temperature of the radiator circuit. The vehicle control system can send a signal to the cooling fan pump that is adapted to the radiator temperature. One such signal may be a temperature signal that is adapted to control the speed of the radiator fan, but where the radiator speed is controlled by the pump pressure by the electrical signal. In this way, the pump must not supply more oil than necessary to the cooling fan motor 7, thereby preserving energy. The hydraulic brake system of the vehicle is also connected to the pump 5 by a brake valve 9. The brake system accumulator can be charged in parallel with the cooling fan or, at a great brake demand, the control system may order the pump 5 to charge the brake system individually. In this case, the cooling fan motor 7 is temporarily disconnected from the pump 5 by a cooling fan valve 8 controlled by the control system. When the brake pressure reaches a predefined level, the cooling fan valve 8 is opened and the cooling fan motor can operate again.

It is also possible to control the flow of the second hydraulic pump by setting the displacement of the pump, where the flow of the second hydraulic pump is controlled by an electric displacement signal by the vehicle control system.

In conventional systems, the cooling fan pump 5 is only connected to the cooling fan and the brake system as described above, and has no connection to the lift arm hydraulic cylinder system. In the inventive system, the connection of the cooling fan pump to the BSS valve 12 of the boom suspension system 3 is governed by an electrically controlled valve 13, which is controlled by the vehicle control system. Valve 13 is opened when the accumulator is charged. Valve 13 is spring-loaded such that the idle position of the valve is closed.

A typical charging operation in which the inventive arrangement is used will now be described with a wheel loader loading gravel as example. However, the inventive arrangement is useful for all types of loading and for goods handling of all types of goods, such as pallets, blocks and light materials. When a bucket of gravel is to be loaded, the driver engages the kick down function of the vehicle, which in the described vehicle is engaged at the same time as the first gear is engaged by a switch, in order to have a maximum breakout force to drive the bucket into the gravel heap. The boom suspension system is inactivated by an electronic control unit (ECU, not shown) of the vehicle control system and since the bucket is lowered and empty, the pressure in the lift cylinders and in the accumulator will thus be low. As soon as the boom suspension system is inactivated, the accumulator will be pre-charged to a first pressure in a first charging step. In the described example, the first pressure is set to 100 bars, but can be set to other values, depending on the system in which the arrangement is used. The ECU disengages the cooling fan motor by closing valve 8, and further opens valve 13, closes valve 14 and sends a low pressure set value of e.g. 30 bars to the pressure regulator 6 of the cooling fan pump 5. The ECU will then ramp up the pressure set value according to a predefined pressure ramp function which in the described example ranges from 30 to 100 bars. The ramp function may be adapted to the rotational speed of the cooling fan pump such that the first pressure is reached in a predefined time interval. The ramp function may also be adapted to other parameters, such as the hydraulic oil temperature. When the first pressure is reached, valve 13 is closed by the ECU and the accumulator is now pre-charged to 100 bars. At the same time, the ECU opens valve 8 and sends a new pressure set value to the cooling fan pump, corresponding to the cooling need of the vehicle. During the loading operation of the bucket, the bucket is lifted above the ground and is also tilted.

When the bucket is loaded, the driver engages the reverse gear. At the same time, a control signal is sent to the ECU that the boom suspension system can be activated again. The control signal may be generated by the same switch that activates the reverse gear or by a separate switch. In the described vehicle, the boom suspension system is automatically activated when the kick-down function is disengaged. Before the actual activation of the boom suspension system, i.e. before the connection of the accumulator to the lift cylinder system, the ECU commences the charging of the accumulator with the second charging step. Again, the cooling fan motor is disconnected by closing valve 8, valve 13 is opened and the ECU sends a new pressure set value to the to the pressure regulator 6 of the cooling fan pump 5. The pressure set value is this time the first pressure, in this example 100 bars. The ECU will now ramp up the pressure set value according to a second predefined pressure ramp function which in the described example ranges from 100 to 150 bars. The second ramp function may also be adapted to the rotational speed of the cooling fan pump such that the second pressure is reached in a predefined time interval. During the second step of the charging cycle, the pressure in the accumulator will be raised to the same pressure as in the lift arm hydraulic cylinder system. When the cooling fan pump raises the pressure according to the second ramp function, the BSS valve 12 will compare the pressure in the accumulator with the pressure in the lift cylinders. When the pressure is equal, valve 11 of the BSS valve 12 will close. The charging of the accumulator will thus stop and the cooling fan pump will not pump any more oil. Since the described charging arrangement is adapted to be implemented in an existing hydraulic system, there is no pressure sensor that measures the actual pressure in the accumulator. The cooling fan pump will thus continue with the pressure ramp function until the end pressure value is reached without supplying any oil. When the ramp function is completed, the cooling fan motor is engaged by opening valve 8 and the cooling fan pump continues to power the cooling fan as before. The ECU will now activate the boom suspension system by opening BSS valve 12.

In this way, it is secured that the pressure in the accumulator is the same as the pressure in the lift arm hydraulic cylinder system when the boom suspension system is activated. An unexpected and sudden movement of the lift arms and the bucket is thus avoided. At the same time, energy is preserved since the arrangement does not charge the accumulator more than necessary and since the arrangement charges the accumulator with a lower pressure difference, where the pressure between the charging pump and the accumulator is reduced. Experiments have shown that approximately 2% of the energy loss in the hydraulic system can be preserved, depending on load cycles and the type of use. This can reduce the fuel consumption of the vehicle by approximately 1%.

If the cooling fan pump is occupied by charging the brake system when the boom suspension system is disengaged, the ECU may prioritize the brake charging over the accumulator charging. In this case, the ECU can open valve 14 and close valve 13. In this way, the accumulator will be charged from the first pump 4 in a conventional way, such that the accumulator pressure will be e.g. 150 bars. When the boom suspension system is activated, the excessive pressure will be drained from the accumulator by the BSS valve 12 in a conventional way before the lift cylinders are connected to the accumulator.

The same will be the case if the radiator system is very warm and the cooling fan pump is occupied by powering the cooling fan. The ECU will detect this situation and will then open valve 14 and close valve 13 such that a conventional charging of the accumulator can be performed. In this way, the boom suspension system must not wait until the cooling fan pump is available for accumulator charging.

If there is a breakdown of the electrical control system such that valves 13 and 14 do not receive any electrical signals, the charging of the accumulator can also be performed in the conventional way by the first pump, since valve 13 is closed when non-energized and valve 14 is open when non-energized.

In the inventive accumulator charging arrangement, the accumulator is not charged by the main pump as in conventional systems. Instead, a supplementary pump, in this case the cooling fan pump, is used to supply the charging pressure to the accumulator. One advantage of this is that the supply pressure of the cooling fan pump is electrically controllable. This means that the charging pressure of the accumulator can be regulated to a predefined pressure level and must not charge the accumulator more than necessary. The charging of the accumulator can also be performed with a smaller pressure difference between the pressure of the charging pump and the pressure in the accumulator. Another advantage is that the full capacity of the main pump can be used for the loading system of the vehicle and must not be divided to also charge the accumulator. This is achieved by only adding two simple on-off valves to an existing system, together with new control software. Such a system can thus also be implemented in existing vehicles, in order to preserve fuel.

Figure 3:
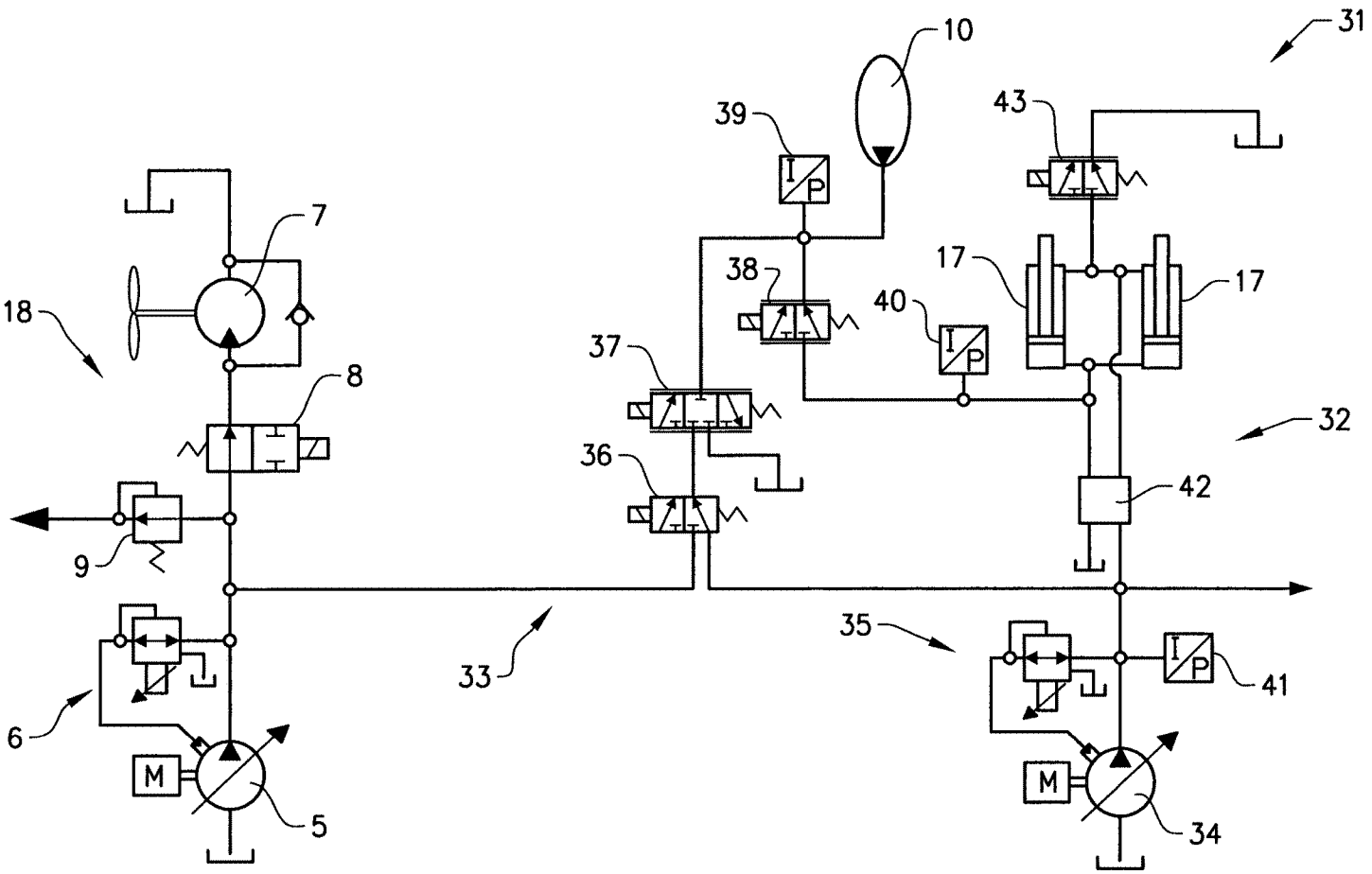
FIG. 3 shows a schematic hydraulic system comprising a second embodiment of the accumulator charging arrangement according to the invention.

FIG. 3 shows schematically a part of a hydraulic system used in a heavy vehicle, in which pressure sensors are used. Also in this example, a wheel loader is used as an example of a heavy vehicle. The part of the hydraulic system shown comprises a lift arm hydraulic cylinder system 32, a boom suspension system 33, an inventive accumulator charging arrangement 33 and the radiator cooling system 18.

The lift arm hydraulic cylinder system 32 comprises at least one lift cylinder 17, in the shown example two lift cylinders are used, a lift valve 42 which is operated by an operator for lifting and lowering the bucket, a valve 43 used to drain the lift cylinders when lowering the bucket, and a pressure sensor 40 that measures the pressure in the lift arm hydraulic cylinder system. The lift arm hydraulic cylinder system 32 is powered by a first hydraulic pump 34, which may be a main hydraulic pump and which is electrically controllable with a pressure regulator 35 and a pressure sensor 41. The first hydraulic pump 34 may also be shared by other systems of the vehicle, which is controlled by the load sensing system of the vehicle. The fluid from the first hydraulic pump 34 is fed to the lift cylinders via the lift valve 42 which is controlled by the operator, either directly or through the vehicle control system. The pressure in the lift cylinders will thus vary depending on the operation performed. The main pump 4 can also be connected to the accumulator through a valve 36. The hydraulic system further comprises a three-position valve 37, a valve 38 for connecting the accumulator to the lift cylinders and a pressure sensor 39 which measures the pressure in the accumulator. During normal operation of the vehicle, valve 36 will be set in an on-position, in which the cooling fan pump 5 is connected to valve 37. Valve 36 is spring-loaded such that the first hydraulic pump 34 is connected to valve 37 when in a non-energized state. The radiator cooling system 18 is the same as described above. An ECU (not shown) comprised in the vehicle control system controls the valves.

A typical load operation will now be described with a wheel loader loading gravel. The load operation is the same as described above. When a bucket of gravel is to be loaded, the driver engages the kick down function, which in the described vehicle is engaged when the first gear is engaged by a switch, in order to have a maximum breakout force to drive the bucket into the gravel heap. The engagement of the kick-down function causes the ECU to disengage the boom suspension system. As soon as the boom suspension system is disengaged, the accumulator will be pre-charged to a first pressure in a first charging step. In this example, the first pressure can be a predefined value, e.g. 100 bars, but the first pressure can also be an adaptive value that e.g. is calculated using previous accumulator pressure values. In one example, the pressure value of the accumulator at the previous activation of the boom suspension system can be used as the set value. Since many vehicles perform operations that are repetitive, such an approach may save time in some cases.

The ECU disengages the cooling fan motor by closing valve 8 and sets valves 36 and 37 such that the cooling fan pump is connected to the accumulator 10. The ECU sends a pressure set value to the pressure regulator of the cooling fan pump that is slightly higher than the pressure in the accumulator measured by pressure sensor 39. In this way, an energy efficient pump action is obtained where losses is minimized. When the first pressure is reached, valve 37 is closed and the accumulator is now pre-charged to the first pressure. At the same time, the ECU opens valve 8 and sends a new pressure set value to the cooling fan pump, corresponding to the cooling need of the vehicle. During loading of the bucket, the bucket is in the loading operation lifted some and also tilted.

When the bucket is loaded, the driver engages the reverse gear. At the same time, a control signal is sent to the ECU that the boom suspension system can be activated again. The control signal may be generated by the same switch that activates the reverse gear or by a separate switch. Before the actual activation of the boom suspension system, the ECU commences the charging of the accumulator with the second charging step. Again, the cooling fan is disconnected by closing valve 8, valve 37 is set to connect the cooling fan pump to the accumulator and the ECU sends a pressure set value to the pressure regulator 6 of the cooling fan pump 5 that is slightly higher than the pressure in the accumulator measured by pressure sensor 39. During the second step of the charging cycle, the pressure in the accumulator will be raised to the same pressure as in the lift cylinders, which is measured by pressure sensor 40. When the pressure is equal, valve 37 is closed by the ECU and the cooling fan pump is returned to power the cooling fan motor by opening valve 8. The ECU will now activate the boom suspension system by connecting the accumulator to the lift cylinders by opening valve 38. If the pressure in the accumulator for some reason is higher than the pressure in the lift cylinders just before the engagement of the BSS, e.g. due to some of the load falling of the bucket when the accumulator is charged, the excessive pressure in the accumulator can be drained through valve 37.

In this way, it is secured that the pressure in the accumulator is the same as the pressure in the lift arm hydraulic cylinder system when the boom suspension system is activated. An unexpected and sudden movement of the boom arm is thus avoided. At the same time, energy is preserved since the arrangement does not charge the accumulator more than necessary and since the charging is performed with a lower pressure difference.

If the cooling fan pump is occupied by charging the brake system when the boom suspension system is deactivated, the ECU may prioritize the brake charging over the accumulator charging. In this case, the ECU can open valve 36 and open valve 37 such that the accumulator is charged from the first hydraulic pump 4 in a conventional way, to a pressure of e.g. 150 bars. When the boom suspension system is activated, the excessive pressure can be drained from the accumulator through valve 37 before the lift arm hydraulic cylinder system is connected to the accumulator. It is also possible to let the charging of the accumulator wait until the charging of the brake system is completed, and then open valve 37 such that the accumulator can be charged by the cooling fan pump.

If the radiator cooling system is very warm and the cooling fan pump is occupied by powering the cooling fan motor, valves 36 and 37 can be set such that the accumulator is charged from the first hydraulic pump 4 in a conventional way.

If there is a breakdown in the electrical control system such that valve 36 does not receive any electrical signals, the charging of the accumulator can also be performed in the conventional way by the first hydraulic pump, since the first hydraulic pump is connected to valve 37 when valve 36 is non-energized.

Figure 4:
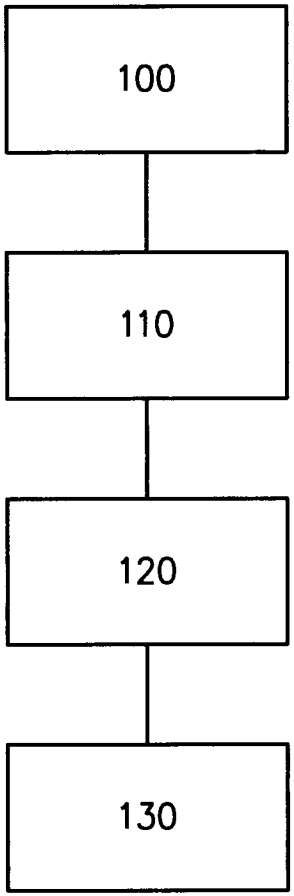
FIG. 4 shows a schematic flow chart of an inventive method for charging an accumulator according to the invention.

FIG. 4 shows a schematic flow chart of a method for charging an accumulator with a second hydraulic pump, where the accumulator is used in a boom suspension system of a heavy vehicle. The exemplified vehicle is here a front wheel loader. In the shown example, the hydraulic pump is arranged to drive a hydraulic motor connected to a cooling fan.

In step 100, the boom suspension system of the vehicle is inactivated. The boom suspension system is inactivated when the bucket of the wheel loader is to be filled or when the wheel loader is to lift a heavy item. In the shown example, the boom suspension system is inactivated automatically when the kick down function of the vehicle is engaged. It is of course also possible to inactivate the boom suspension system manually by a switch.

The inactivation of the boom suspension system starts a first charging step 110 of the accumulator, in which the accumulator is charged to a first pressure. The accumulator is now pre-charged to a first, predefined pressure level.

In step 120, the boom suspension system is to be activated again. A control signal is thus sent from the ECU indicating that the boom suspension system can be activated. In the shown example, the boom suspension system is activated when the kick down function is disengaged, which in turn is disengaged when the reverse gear is engaged. The boom suspension system may of course also be activated in other suitable ways, e.g. manually. Before the actual activation of the boom suspension system, the accumulator is charged to a second pressure. The second pressure is preferably substantially equal to the current load pressure in the lift arm hydraulic cylinder system. When the second pressure is reached, the boom suspension system can be activated.

In step 130, the boom suspension system is activated by connecting the accumulator to the lift arm hydraulic cylinder system. In this way, the boom suspension system is activated without any sudden movements of the lift arms of the vehicle, which may be the case if the boom suspension system is activated when there are different pressures in the accumulator and the lift cylinders. The charging of the accumulator is with the inventive charging method achieved in a cost-effective and energy-preserving manner, which at the same time allows for a safe activation of the boom suspension system without sudden load drops.

The invention is not to be regarded as being limited to the embodiments described above, a number of additional variants and modifications being possible within the scope of the subsequent claims.

REFERENCE SIGNS

1: Accumulator charging arrangement
2: Lift arm hydraulic cylinder system
3: Boom suspension system
4: Main hydraulic pump
5: Cooling fan pump
6: Pressure regulator valve
7: Cooling fan motor
8: Cooling fan valve
9: Brake valve
10: Accumulator
11: Valve
12: BSS valve
13: Valve
14: Valve
15: Lift valve
16: Valve
17: Lift cylinder
18: Radiator cooling system
19: Cooling fan
31: Accumulator charging arrangement
32: Lift cylinder system
33: Boom suspension system
34: Main hydraulic pump
35: Pressure regulator
36: Valve
37: Valve
38: Valve
39: Pressure sensor
40: Pressure sensor
41: Pressure sensor
42: Lift valve
43: Valve
50: Vehicle
51: Engine compartment
52: Driver cab
53: Radiator system
54: Hydraulic system
55: Lift arm

The invention claimed is:

1. An arrangement for charging an accumulator with hydraulic fluid, wherein the accumulator is used in a hydraulic boom suspension system for a lift arm of a vehicle, the arrangement comprising a first hydraulic pump arranged to supply hydraulic fluid to a hydraulic cylinder system of the lift arm, a second hydraulic pump arranged to supply hydraulic fluid to a second hydraulic system, wherein the second hydraulic pump is further arranged to supply hydraulic fluid for charging the accumulator, a first charging function adapted to charge the accumulator to a first pressure using the second pump by ramping up the pressure in the second pump according to a predefined pressure ramp function to a first pressure when the boom suspension system is inactivated, and a second charging function adapted to charge the accumulator to a second pressure using the second pump by further ramping up the pressure in the second pump according to a second predefined pressure ramp function to a level which is greater than the first pressure and substantially equal to a current load pressure in the lift arm hydraulic cylinder system when a control signal indicates that the boom suspension system is to be activated.

2. Arrangement according to claim 1, wherein the second hydraulic system is a hydraulic motor for driving a cooling fan of the vehicle.

3. Arrangement according to claim 1, wherein the second hydraulic pump is arranged to be controlled by a pressure regulator valve, by which the pressure of the second hydraulic pump can be set by an electric signal.

4. Arrangement according to claim 1, wherein the arrangement has a valve for disconnecting the cooling fan motor from the second hydraulic pump when the accumulator is to be charged.

5. Arrangement according to claim 1, wherein the first pressure is in the range between 80 and 120 bar.

6. Arrangement according to claim 1, wherein the pressure ramp function is dependent on the rotational speed of the second hydraulic pump.

7. Arrangement according to claim 1, wherein the arrangement is adapted to connect the accumulator to the lift arm hydraulic cylinder system when the pressure in the accumulator is substantially equal to the current load pressure in the lift arm hydraulic cylinder system.

8. Arrangement according to claim 1, wherein the arrangement further comprises a valve that is adapted to connect the first hydraulic pump to the accumulator and to disconnect the second pump from the accumulator when a temperature signal for the cooling fan is above a predefined level and/or when a brake pressure signal is below a predefined level.

9. Arrangement according to claim 8, wherein the valve is spring-loaded such that the first hydraulic pump is connected to the accumulator and that the second pump is disconnected from the accumulator when the valve receives no electrical signal.

10. A working machine comprising an arrangement according to claim 1.

11. A method for charging an accumulator with hydraulic fluid, wherein the accumulator is used in a hydraulic boom suspension system for a lift arm of a vehicle, the lift arm being provided with a hydraulic cylinder system including a first hydraulic pump arranged to supply hydraulic fluid to the hydraulic cylinder system and a second hydraulic pump arranged to supply hydraulic fluid to a second hydraulic system, wherein the second hydraulic pump is further arranged to supply hydraulic fluid for charging the accumulator, comprising:

charging the accumulator to a first pressure using the second pump by ramping up the pressure in the second pump according to a predefined pressure ramp function to a first pressure when the boom suspension system is inactivated, and charging the accumulator to a second pressure using the second pump by further ramping up the pressure in the second pump according to a second predefined pressure ramp function to a level which is greater than the first pressure and substantially equal to a current load pressure in the lift arm hydraulic cylinder system when a control signal indicates that the boom suspension system is to be activated.

12. Method according to claim 11, comprising connecting the accumulator to the lift arm hydraulic cylinder system when the second pressure is substantially equal to the current load pressure in the lift arm hydraulic cylinder system.

13. Method according to claim 11, wherein the second hydraulic pump is arranged to supply hydraulic fluid to a hydraulic motor for driving a cooling fan of the vehicle.

14. Method according to claim 13, comprising controlling the second hydraulic pump by a pressure regulator valve, whereby the pressure of the second hydraulic pump is set by an electric signal.

15. Method according to claim 13, comprising controlling the flow of the second hydraulic pump, whereby the flow of the second hydraulic pump is set by an electric displacement signal.

16. Method according to claim 13, comprising connecting the first hydraulic pump to the accumulator and disconnecting the second pump from the accumulator when a temperature signal for the cooling fan is above a predefined level and/or when a brake pressure signal is below a predefined level.

17. Method according to claim 11, comprising generating the control signal when a reverse gear of the vehicle is activated.

18. A computer comprising program code for performing all the steps of claim 11.

19. A non-transitory computer program product comprising rant code stored on a computer readable medium for performing all the steps of claim 11.

* * * * *